US006799910B2

(12) United States Patent
Tateyama

(10) Patent No.: US 6,799,910 B2
(45) Date of Patent: Oct. 5, 2004

(54) PROCESSING METHOD AND PROCESSING APPARATUS

(75) Inventor: Kiyohisa Tateyama, Kikuchi-Gun (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 10/434,128

(22) Filed: May 9, 2003

(65) Prior Publication Data

US 2003/0210907 A1 Nov. 13, 2003

(30) Foreign Application Priority Data

May 10, 2002 (JP) ..... 2002-134882

(51) Int. Cl.[7] ..... G03D 5/00

(52) U.S. Cl. ..... 396/611; 118/52; 118/697; 118/719; 438/5; 716/1

(58) Field of Search ..... 396/604, 611, 396/627; 438/5; 716/1; 118/52, 697, 719

(56) References Cited

U.S. PATENT DOCUMENTS

| | | | | |
|---|---|---|---|---|
| 5,740,065 A | * | 4/1998 | Jang et al. | 716/1 |
| 5,849,602 A | * | 12/1998 | Okamura et al. | 438/5 |
| 6,258,169 B1 | * | 7/2001 | Asano | 118/697 |
| 6,264,748 B1 | | 7/2001 | Kuriki et al. | 118/719 |
| 6,402,400 B1 | | 6/2002 | Ueda et al. | 396/611 |

* cited by examiner

*Primary Examiner*—D. Rutledge
(74) *Attorney, Agent, or Firm*—oblon, Spivak, McClelland, Maier & Neustadt, PC

(57) ABSTRACT

After the first workpieces have been processed in the first process portion while the second workpieces are being processed in the second process portion, the first process portion in which the first process condition has been set for the third process condition. By repeating such processes, a plurality of workpieces can be successively processed in different types of process conditions.

17 Claims, 9 Drawing Sheets

PROCESSING METHOD AND PROCESSING APPARATUS

BACKGROUND OF THE INVENTION

1. Field of the Invention

The present invention relates to a processing method and a processing apparatus, in particular, a processing method and a processing apparatus for successively processing a plurality of workpieces such as glass substrates for liquid crystal display devices (LCD), semiconductor wafers, and so forth in different process conditions.

2. Description of the Related Art

Generally, when an LCD is produced, like in a semiconductor wafer producing process, a predetermined film is formed on an LCD glass substrate (hereinafter referred to as LCD substrate) as a workpiece. Thereafter, a photoresist solution is coated on the formed film. As a result, a resist film is formed. The resist film is exposed corresponding to a predetermined circuit pattern. Thereafter, a developing process is performed for the resist film. In such a manner, namely by so-called photolithography technology, the circuit pattern is formed.

In the photolithography technology, after a cleaning process is performed for an LCD substrate as a workpiece, a dehydration baking process is performed. Thereafter, an adhesion process (hydrophobic process) and then a cooling process are performed. Thereafter, the LCD substrate is transferred to a coating unit. In the coating unit, resist is coated on the LCD substrate. The resist-coated LCD substrate is transferred to a thermal process unit. In the thermal process unit, a thermal process (pre-baking process) is performed for the LCD substrate. As a result, moisture of the resist is evaporated. Thereafter, the LCD substrate is transferred to an exposing unit. In the exposing unit, an exposing process is performed for the LCD substrate. Thereafter, the LCD substrate is transferred to a developing unit. In the developing unit, a developing process is performed for the LCD substrate. Thereafter, the LCD substrate is transferred to a thermal process unit. In the thermal process unit, a thermal process (post-baking process) is performed for the LCD substrate. In such a sequence of processes, a predetermined circuit pattern is formed on the resist layer.

In the processes of the photolithography technology, since different types of resist films, insulating films, and so forth may be formed on the front surface of one LCD substrate, process solution supplying nozzles for a plurality of types of process solutions may be disposed in the coating unit. Depending on the purpose, a process solution for a resist film or an isolation film (planarizing film) is supplied from a predetermined process solution supplying nozzle to the LCD substrate. In such a manner, a thin film is formed on the LCD substrate.

In that case, after the coating process is performed, the temperature condition of a thermal process varies depending on the type of the process solution, the film thickness, and so forth. Thus, the thermal processes should be performed in different temperature conditions. Consequently, after a thermal process has been performed for LCD substrates of a lot to be processed first (hereinafter sometimes referred to as first lot), if a thermal process is performed for LCD substrates of a lot to be processed next (hereinafter sometimes referred to as second lot), it might be necessary to prepare two sets of thermal process units or change the temperatures of one thermal process unit for performing the thermal processes for workpieces of the two lots.

However, when two sets of thermal process units are prepared, the size of the entire units might become large. In addition, the facility cost of the units might rise. In particular, when LCD substrates that are becoming large year by year, which is a current tendency, are produced, the entire units become very large. In contrast, in the case that the temperatures of one thermal process unit are changed, although the size of the unit can be reduced, it might take a long time until a desired process temperature has been set. Thus, the process performance remarkably decreases.

SUMMARY OF THE INVENTION

The present invention has been made from the above-described point of view. An object of the present invention is to provide a processing method and a processing apparatus that allow a plurality of workpieces to be successively processed in different types of process conditions while the size reduction of the apparatus is kept.

To solve the forgoing problem, the present invention is a processing method, comprising the steps of (a) setting a first process portion for processing a plurality of workpieces for a first process condition; (b) after the step (a), causing the first process portion to process a first workpiece of the plurality of workpieces in the first process condition; (c) setting a second process portion for processing the plurality of workpieces for a second process condition; (d) after the step (c), causing the second process portion to process a second workpiece of the plurality of workpieces in the second process condition; (e) after the step (b) and during the step (d), changing and setting the first process portion for the second process condition; and (f) after the step (e), causing the first process portion to process a third workpiece of the plurality of workpieces in the second process condition.

According to the present invention, at the step (e), after the first workpieces have been processed in the first process portion while the second workpieces are being processed in the second process portion, the first process portion in which the first process condition has been set for the third process condition. By repeating such processes, a plurality of workpieces can be successively processed in different types of process conditions. In other words, after the second workpieces have been processed in for example the second process portion (after the step (d)), while the third workpieces are being processed in the first process portion (during the step (f)), the second process portion in which the second process condition has been set for the third process condition. In that case, the third process condition is different from the second process condition. However, the third process condition is not always different from the first process condition. In such a manner, the increase of the number of units is actively suppressed and the size reduction of the apparatus is kept. In addition, a plurality of workpieces can be successively processed in different types of process conditions.

According to the present invention, for example, the step (c) may be performed during the step (a) (or at the same time as the step (a)), after the step (a), or during the step (b). The first, second, and third workpieces are different objects.

According to one embodiment of the present invention, the step (c) is performed during the step (b). When the second process condition is set as late as possible, energy loss can be prevented. That is especially effective when the process of the second process portion is a thermal process.

According to the present invention, the step (b) has the step of (g) causing the first process portion to process the first workpiece as a workpiece contained in a first lot. The step (d) has the step of (h1) causing the second process portion to process the second workpiece as a workpieces contained in a second lot to be processed after the first lot. The step (f) has the step of (h2) causing the first process portion to process the third workpiece as a workpieces contained in the second lot to be processed after the first lot. According to the present invention, at least one of a plurality of workpieces contained in the first lot is processed in the first process portion. At least one of a plurality of workpieces contained in the second lot is processed in the second process portion. After the process of the first process portion has been completed, at least one of the plurality of workpieces contained in the second lot is processed in the first process portion. Thus, the present invention is very effective when workpieces are processed as a lot.

According to the present invention, the first process portion has a first process unit and a second process unit for processing the plurality of workpieces and the there are a plurality of third workpieces. The step (e) has the steps of (i) changing and setting the first process unit for the second process condition; and (j) after the step (i), changing and setting the second process unit for the second process condition. The step (f) has the steps of (k) after the step (i), causing the first process unit to process one of the plurality of third workpieces; and (l) after the step (j), causing the second process unit to process another workpiece of the plurality of third workpiece. Thus, since a plurality of workpieces are simultaneously processed, the throughput of the units is improved. In addition, a plurality of workpieces can be successively processed even in different types of process conditions.

According to the present invention, before the step (a), storing a time necessary after the step (c) until starting the step (d); and performing the step (c) corresponding to the stored time, so that can be starting the step (d) before performing the step (e) at latest. Since the information about a time necessary after the second process portion is set for the second process condition until the second process portion becomes a ready state for processing the workpieces in the second process condition is pre-stored, for example the second process condition can be set as late as possible. As a result, energy loss can be prevented. That embodiment is especially effective when the process of the second process portion is a thermal process.

According to the present invention, the step (a) is performed by setting the first process portion for a first temperature condition as the first process condition. The step (b) is performed by causing the first process portion to process the workpiece in the first temperature condition. The step (c) is performed by setting the second process portion for a second temperature condition as the second process condition. The step (d) is performed by causing the second process portion to perform a thermal process for the workpiece in the second temperature condition. The step (e) is performed by setting the first process portion for the second temperature condition as the second process condition. The step (f) is performed by causing the first process portion to perform a thermal process for the workpiece in the second temperature condition.

The present invention is a processing apparatus, comprising a first process portion for processing a plurality of workpieces in at least a first process condition and a second process condition that is different from the first process condition; a second process portion for processing the workpieces in at least the second process condition; and controlling means for changing the first process portion to the second process condition and causing the first process portion to process a third workpiece of the workpieces in the second process condition, after the first process portion has processed a first workpiece of the workpieces in the first process condition while the second process portion is processing a second workpiece of the workpieces.

According to the present invention, with such controlling means, a plurality of workpieces can be successively processed even in different types of process conditions. In other words, after the second workpieces have been processed in for example the second process portion, while the third workpieces are being processed in the first process portion, the second process portion is set for the third process condition. In that case, the third process condition is different from the second process condition. However, the third process condition is not always different from the first process condition. In such a manner, the increase of the number of units is actively suppressed and the size reduction of the apparatus is kept. In addition, a plurality of workpieces can be successively processed in different types of process conditions.

According to the present invention, the first workpiece is contained in a first lot and the second and third workpieces are contained in a second lot to be processed after the first lot.

According to the present invention, the first process portion has a first thermal process unit for performing a thermal process for the workpieces in the first process condition and the second process condition as a first temperature condition and a second temperature condition, respectively. The second process portion has a second thermal process unit for performing a thermal process for the workpieces in the second process condition as the second temperature condition.

According to the present invention, the first thermal process unit and the second thermal process unit are vertically disposed. The processing apparatus further comprises a transferring mechanism for transferring the workpieces at least between the first thermal process unit and the second thermal process unit. The controlling means has means for sending a command for causing the workpieces to be successively transferred to the first and second thermal process units in the order from a lower unit to an upper unit. Since a low temperature heat flow and a high temperature heat flow take place downward and upward, respectively, workpieces are successively transferred to the thermal process units in the order from a lower unit to an upper unit by the transferring mechanism. Thus, the workpieces can be processed without loss of thermal energy.

To solve the forgoing problem, the present invention is a processing method for successively processing a plurality of workpieces in different process conditions, the processing method comprising the steps of providing a first process portion to be set for a process condition for a workpiece to be processed first; providing a second process portion to be set for a process condition for a workpiece to be processed next, the second process portion being composed of at least one unit; allowing the first process portion and the second process portion to be changed to their process conditions; while the workpiece to be processed first is being transferred to the first process portion and the workpiece is being processed therein, setting the second process portion for the process condition for the workpiece to be processed next and placing the second process portion in a ready state for processing the workpiece; after the first process portion has processed the workpiece, transferring the workpiece to be processed next to the second process portion and causing the second process portion to process the workpiece; while the second process portion is processing the workpiece, changing the first process portion to the same process condition as that of the second process portion, transferring the workpiece to be processed next to the first process portion whose process condition has been changed, and causing the first process portion to process the workpiece; after the second process portion has processed the workpiece, changing the second process portion to a process condition for a workpiece to be processed after the next and placing the second process portion in a ready state for processing the workpiece; and changing the first process portion and the second process condition to the process condition for the workpiece to be processed next and causing the first process portion and the second process portion to successively process the plurality of workpieces.

According to the present invention, the processing method preferably further comprises the steps of providing the first process portion composed of a plurality of process units; successively changing the process units to the process condition for the workpiece to be processed next; transferring the workpiece to be processed next to the process units whose process conditions have been changed; and causing the process units to process the workpiece.

According to the present invention, the first process portion and the second process portion are thermal process portions for performing thermal processes for workpieces in respectively predetermined temperature conditions.

The present invention is a processing apparatus for successively processing a plurality of workpieces in different process conditions, the processing apparatus comprising a loading and unloading portion for loading and unloading the workpieces; a process portion having a first process portion and a second process portion that can be set for different process conditions for the workpieces, the second process portion being composed of at least one unit; transferring means for transferring and transferring the workpieces between the loading and unloading portion and the process portion; and controlling means for setting the second process portion for a process condition for a workpiece to be processed next while the first process portion is processing a workpiece to be processed first, sending a command to the transferring means so as to transfer the workpiece that has been processed in the second process portion, and changing the first process portion to the process condition for the workpiece to be processed next.

According to the present invention, the first process portion preferably has a plurality of process units. The controlling means is preferably configured to control the process units so that the process units can be successively changed and set for process conditions.

According to the present invention, the first process portion and the second process portion are thermal process units for performing thermal processes for the workpieces in respectively predetermined temperature conditions. In that case, each of the first and second process portions preferably has a holding table for holding a workpiece; heating means for heating the holding table; cooling means for cooling the holding table; temperature detecting means for detecting the temperature of the holding table; and controlling means for controlling the heating means or the cooling means corresponding to a detection signal that is output from the temperature detecting means or a pre-set workpiece process start signal or a pre-set workpiece process end signal.

According to a first aspect of the present invention, while workpieces to be processed first are being transferred to the first process portion and they are being processed therein, the second process portion is set for a process condition for workpieces to be processed next and placed in a ready state for them. After the processes of the first process portion have been completed, the workpieces to be processed next can be transferred to the second process portion and they can be processed therein. In addition, while workpieces are being processed in the second process portion, the first process portion is changed to the same process condition as that of the second process portion. Workpieces to be processed next are transferred to the first process portion whose process condition has been changed and the workpieces are processed therein. Moreover, after the process of the second process portion has been completed, the second process portion is changed to a process condition for workpieces to be processed after the next and placed in a ready state for the workpieces. Likewise, the first process portion and the second process portion are changed to a process condition for workpieces to be processed next and a plurality of workpieces are successively processed. With only at least one unit as the second process portion added, a plurality of workpieces can be successively processed in different process conditions.

According to a second aspect of the present invention, the first process portion is composed of a plurality of process units. Each process unit is successively changed to a process condition for workpieces to be processed next. The workpieces to be processed next are successively transferred to each process unit whose process condition has been changed and the workpieces are successively processed therein. Thus, a plurality of workpieces to be actually processes can be simultaneously processed. Thus, the process efficiency can be further improved.

According to a third aspect of the present invention, since the first process portion and the second process portion are thermal process portions for performing thermal processes for workpieces at respectively predetermined temperature conditions, thermal processes can be successively performed for a plurality of workpieces in different thermal process conditions.

These and other objects, features and advantages of the present invention will become more apparent in light of the following detailed description of a best mode embodiment thereof, as illustrated in the accompanying drawings.

DESCRIPTION OF PREFERRED EMBODIMENTS

Next, with reference to the accompanying drawings, embodiments of the present invention will be described in detail.

Figure 1:
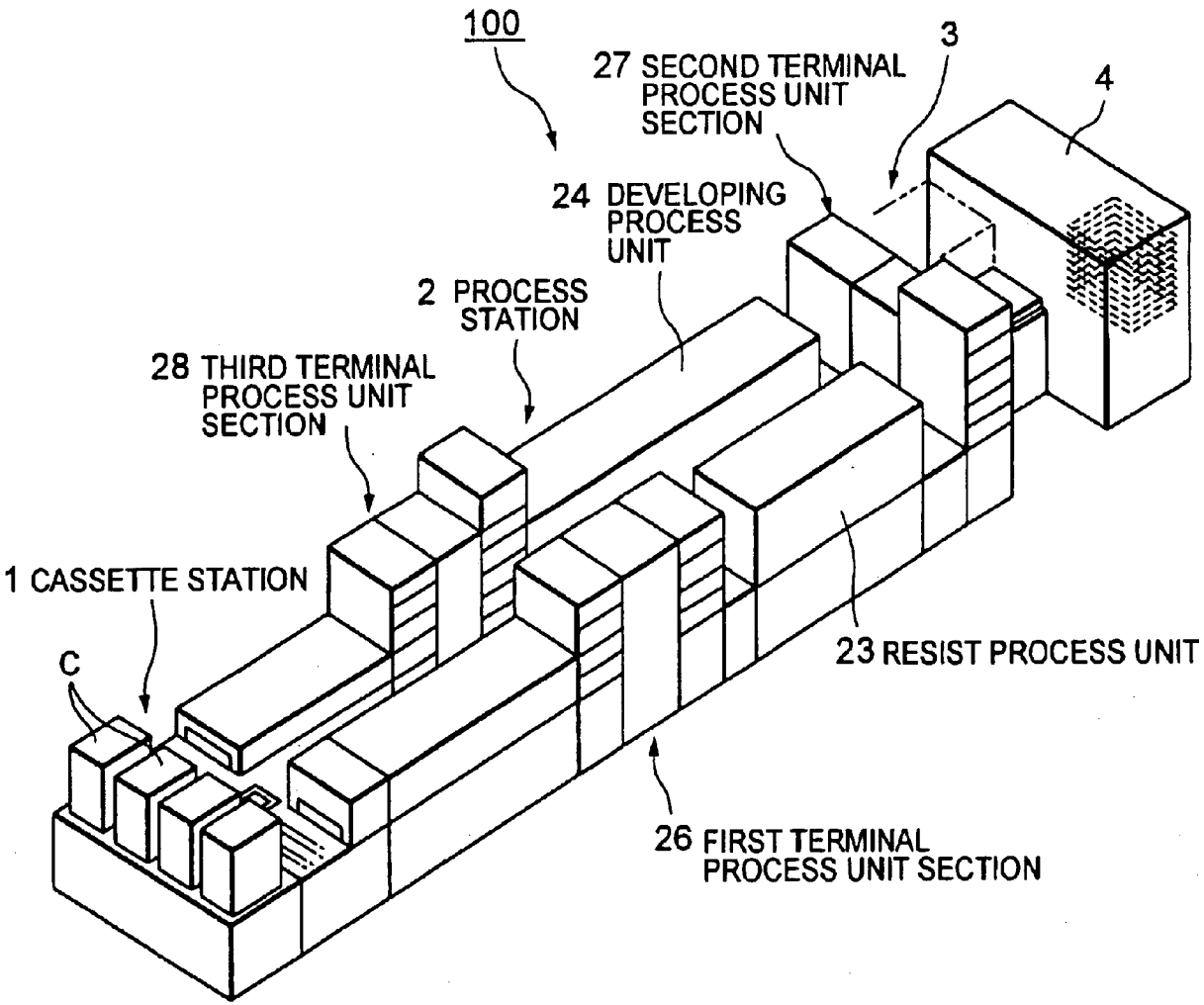
FIG. 1 is a perspective view showing a resist coating and developing process system for LCD glass substrates, the system having a processing apparatus according to one embodiment of the present invention.
Figure 2:
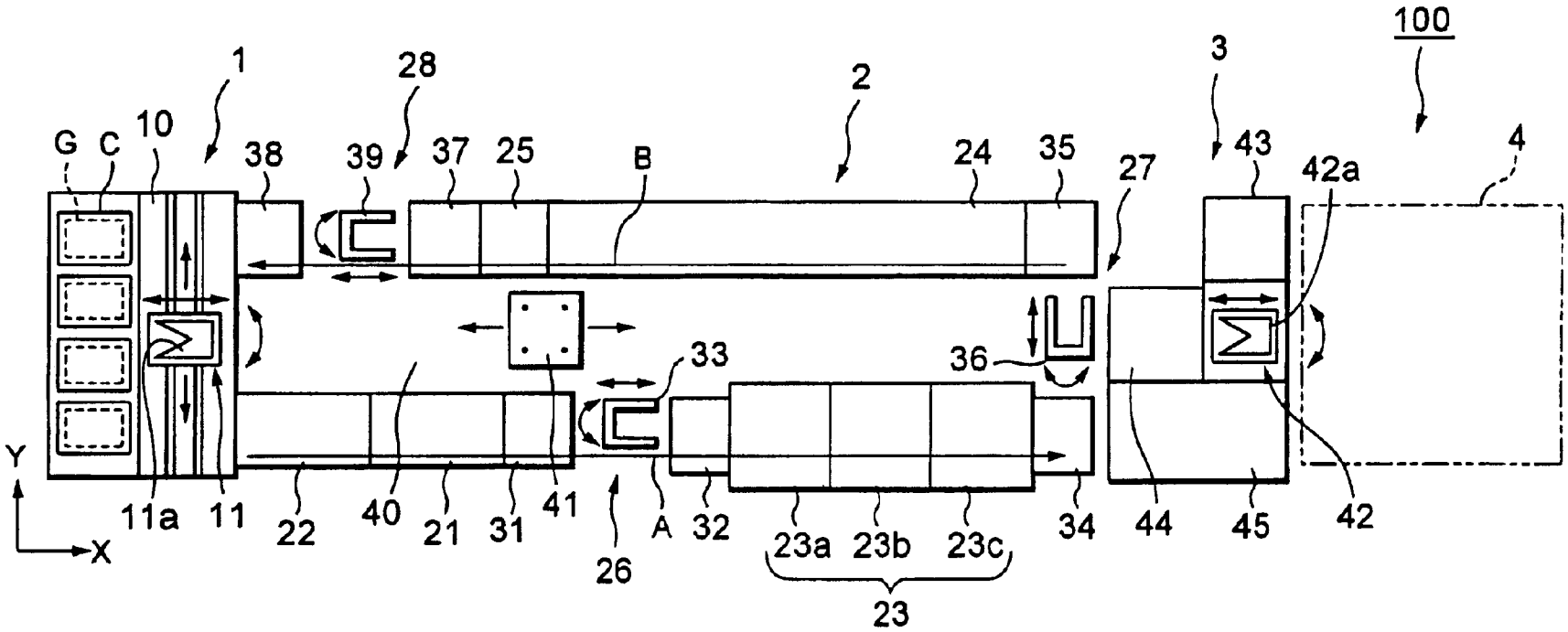
FIG. 2 is a plan view showing the resist coating and developing process system.

FIG. 1 is a perspective view showing a resist coating and developing process system for LCD glass substrates, the system having a processing apparatus according to the present invention. FIG. 2 is a plan view showing an outline of the resist coating and developing process system.

The resist coating and developing process system 100 has a cassette station 1 (loading and unloading portion), a process station 2 (process portion), and an interface station 3 (interface portion). On the cassette station 1, cassettes C are placed. Each cassette C contains a plurality of LCD glass substrates (hereinafter referred to as substrates G) as workpieces. The process station 2 has a plurality of process units that perform a sequence of processes including a resist coating process and a developing process. The interface station 3 transfers substrates G with an exposing unit 4. The cassette station 1 and the interface station 3 are disposed on both ends of the process station 2. In FIG. 1 and FIG. 2, the lengthwise direction of the resist coating and developing process system 100 is referred to as X direction, a direction perpendicular to the X direction on the horizontal plane as Y direction, a direction perpendicular to both the X and Y directions on the horizontal plane as Z direction.

The cassette station 1 has a transferring unit 11 that loads and unloads substrates G between a cassette C and the process station 2. In the cassette station 1, cassettes C are loaded and unloaded to and from the outside of the apparatus. The transferring unit 11 has a transferring arm 11*a*. The transferring arm 11*a* can be traveled on a transferring path 10 formed along the Y direction, which is the direction in which the cassettes C are placed. The transferring arm 11*a* loads and unloads substrates G between the cassettes C and the process station 2.

The process station 2 has two transferring lines A and B that basically extend in the X direction and are disposed in parallel. Along the transferring lines A and B, substrates G are transferred. A scrub cleaning process unit 21 (SCR), a first thermal process unit section 26, a resist process unit 23, and a second thermal process unit section 27 are disposed along the transferring line A when viewed from the cassette station 1 to the interface station 3. In addition, a second thermal process unit section 27, a developing process unit 24 (DEV), an i-ray UV radiating unit 25 (i-UV), and a third thermal process unit section 28 are disposed along the transferring line B when viewed from the interface station 3 to the cassette station 1. An excimer UV radiating unit 22 (e-UV) is disposed on a part of the scrub cleaning process unit 21 (SCR). The excimer UV radiating unit 22 (e-UV) removes organic substance from a substrate G before it is scrubber-cleaned. The i-ray UV radiating unit 25 (i-UV) performs a discoloring process for a developed resist.

The scrub cleaning process unit 21 (SCR) performs a cleaning process and a drying process for a substrate G while it is being almost horizontally transferred, not rotated unlike the conventional unit. Likewise, the developing process unit 24 (DEV) performs a developing solution coating process, a developing solution cleaning process, and a drying process for a substrate G while it is being almost horizontally transferred, not rotated. In each of the scrub cleaning process unit 21 (SCR) and the developing process unit 24 (DEV), a substrate G is transferred by for example a roller transferring mechanism or a belt transferring mechanism. In each of the scrub cleaning process unit 21 (SCR) and the developing process unit 24 (DEV), an loading opening and an unloading opening for a substrate G are disposed on opposite shorter sides. Substrates G are successively transferred to the i-ray UV radiating unit 25 (i-UV) by the same mechanism as that of the developing process unit 24 (DEV).

Figure 3:
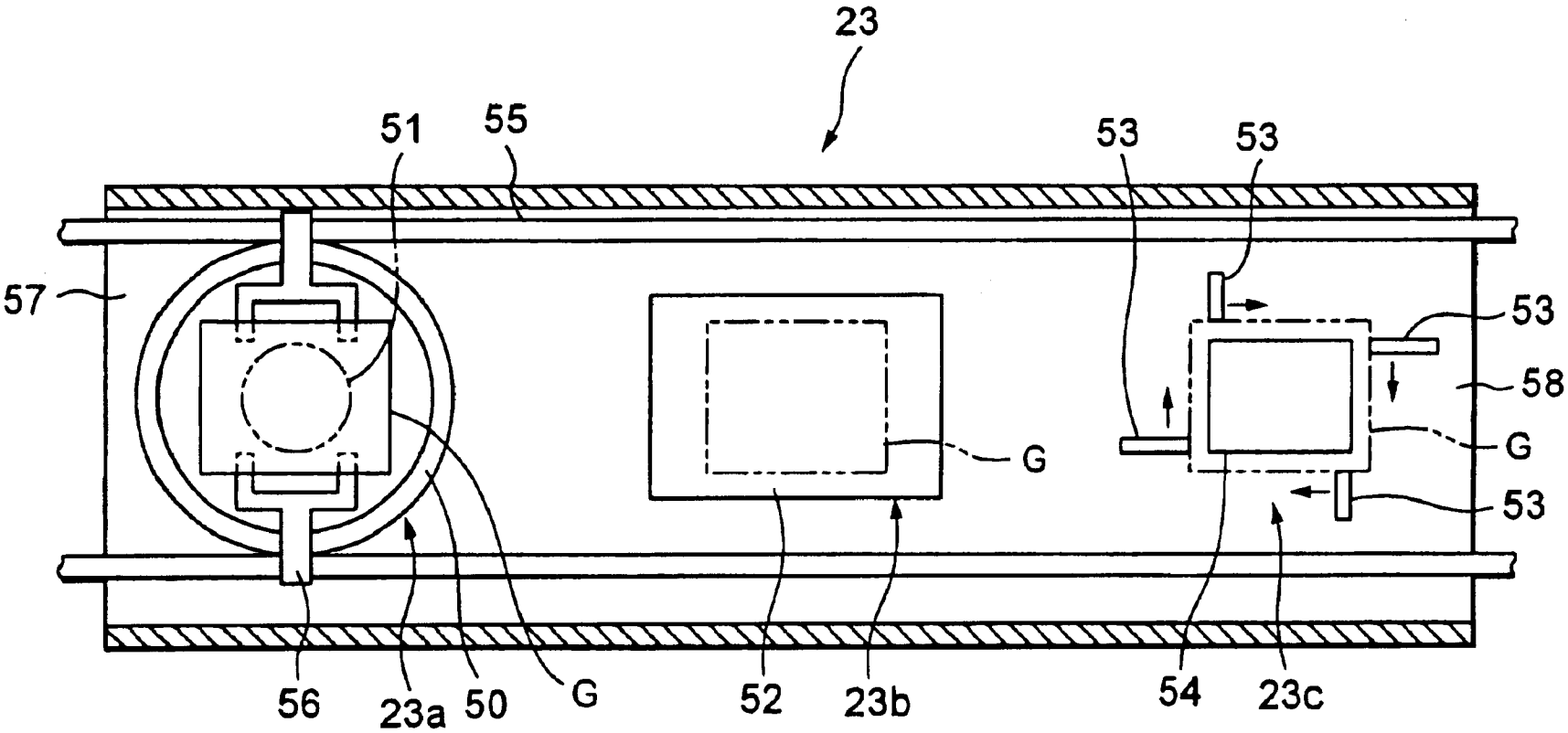
FIG. 3 is a plan view showing a resist coating and developing unit in a resist coating and developing apparatus.

As shown by a plan view of FIG. 3, the resist process unit 23 has a resist coating process unit 23*a* (CT), a reduced pressure drying unit 23*b* (VD), and a periphery resist removing unit 23*c* (ER) that are disposed in the order. In the resist coating process unit 23*a* (CT), a spin chuck 51 rotates a substrate G in a cup 50. A nozzle (not shown) drips resist solution on the substrate G. In the reduced pressure drying unit 23*b* (VD), a resist film formed on a substrate G is dried in a reduced pressure vessel 52 with reduced pressure. In the periphery resist removing unit 23*c* (ER), excessive resist that adheres on the periphery of a substrate G is removed with solvent discharged from solvent discharging heads 53 that can scan four sides of the substrate G placed on a stage 54.

In the resist process unit 23, a substrate G is almost horizontally transferred by a pair of sub arms 56 guided by guide rails 55. The resist process unit 23 has a loading opening 57 and an unloading opening 58 for a substrate G. The loading opening 57 and the unloading opening 58 are formed on opposite shorter sides of the resist process unit 23. The guide rails 55 extend from the loading opening 57 and the unloading opening 58 so that the sub arms 56 transfer a substrate G with the adjacent units.

Figure 4:
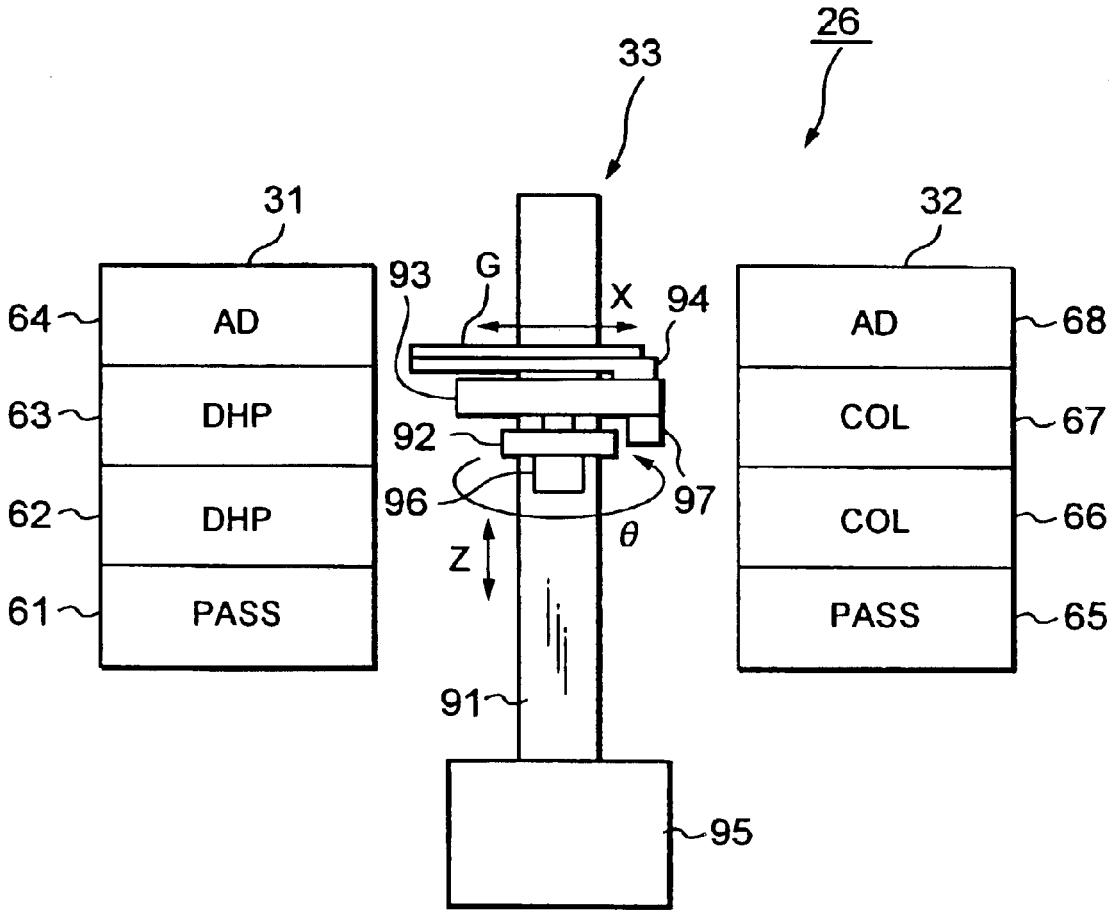
FIG. 4 is a side view showing a first thermal process unit section.

The first thermal process unit section 26 has two thermal process unit blocks 31 and 32 (TB), each of which has thermal process units that perform thermal processes for substrates G and that are vertically disposed. The thermal process unit block 31 (TB) is disposed adjacent to the scrub cleaning process unit 21 (SCR). On the other hand, the thermal process unit block 32 (TB) is disposed adjacent to the resist process unit 23. A first transferring unit 33 (transferring means) is disposed between the two thermal process unit blocks 31 and 32 (TB). As shown with a side view of FIG. 4, the thermal process unit block 31 (TB) has four units of a passing unit 61 (PASS), two dehydrating and baking units 62 and 63 (DHP), and an adhesion process unit 64 (AD) that are vertically disposed in the order when viewed from the bottom. The passing unit 61 transfers a substrate G with the adjacent unit. The dehydrating and baking units 62 and 63 (DHP) perform dehydrating and baking processes for substrates G. The adhesion process unit 64 (AD) performs a hydrophobic process for a substrate G.

On the other hand, the thermal process unit block 32 (TB) has four units of a passing unit 65 (PASS), two cooling units 66 and 67 (COL), and an adhesion process unit 68 (AD) that are disposed in the order when viewed from the bottom. The passing unit 65 (PASS) transfers a substrate G with the adjacent unit. The cooling units 66 and 67 (COL) cool substrates G. The adhesion process unit 68 (AD) performs a hydrophobic process for a substrate G.

The first transferring unit 33 receives a substrate G from the scrub cleaning process unit 21 (SCR) through the passing unit 61, loads and unloads the substrate G among the thermal process units, and transfers the substrate G to the resist process unit 23 through the passing unit 65 (PASS).

The first transferring unit 33 has a guide rail 91, an elevator table 92, a base table 93, a substrate holding arm 94. The guide rail 91 vertically extends. The elevator table 92 is elevated along the guide rail 91. The base table 93 is disposed on the elevator table 92 and is rotatable in horizontal θ direction. The substrate holding arm 94 is movable forward and backward and holds a substrate G. The elevator table 92 is elevated by an elevating mechanism (not shown) such as a ball screw mechanism or a cylinder mechanism that is driven by a motor 95. The base table 93 is rotated by a motor 96. The substrate holding arm 94 is moved forward and backward by a moving mechanism (not shown) driven by a motor 97. Thus, since the first transferring unit 33 is movable upward, downward, forward, backward, and rotatable, it can access any units of the thermal process unit blocks 31 and 32 (TB).

On the other hand, the second thermal process unit section 27 has two thermal process unit blocks 34 and 35 (TB) according to the processing method (processing apparatus) of the present invention. Each of the thermal process unit blocks 34 and 35 (TB) has thermal process units that are vertically disposed. The thermal process unit block 34 (TB) is disposed adjacent to the resist process unit 23. On the other hand, the thermal process unit block 35 (TB) is disposed adjacent to the developing process unit 24 (DEV). A second transferring unit 36 as a transferring means is disposed between the two thermal process unit blocks 34 and 35 (TB).

Figure 5:
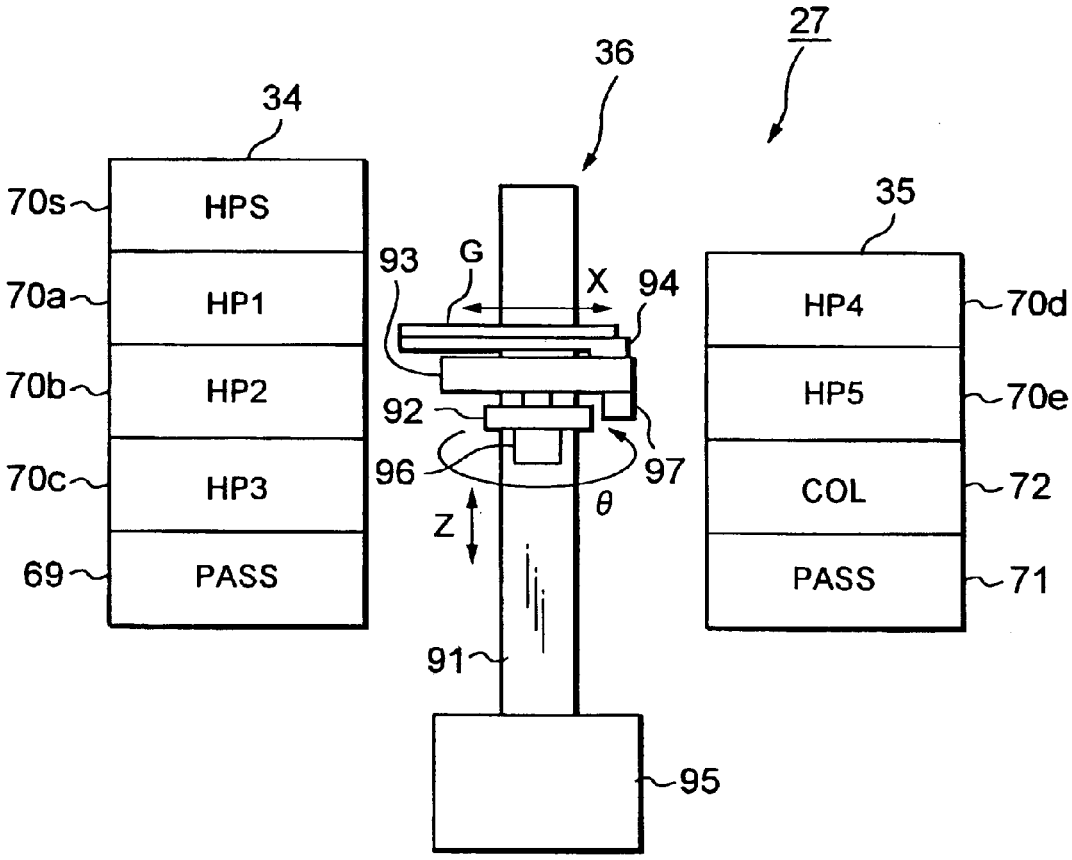
FIG. 5 is a side view showing a second thermal process unit section.

In that case, as shown with a side view of FIG. 5, the thermal process unit block 34 (TB) has five units of a passing unit 69 (PASS), three pre-baking units 70*c* (HP3), 70*b* (HP2), 70*a* (HP1), and an auxiliary pre-baking unit 70*s* (HPS) that are vertically disposed in the order when viewed from the bottom. The passing unit 69 (PASS) transfers a substrate G with the adjacent unit. The pre-baking units 70*c* (HP3), 70*b* (HP2), 70*a* (HP1) are thermal process units that perform pre-baking processes for substrates G. The auxiliary pre-baking unit 70*s* (HPS) is an auxiliary thermal process unit. The reason why the thermal process unit block 34 has three pre-baking units 70*a*, 70*b*, and 70*c* (HP1, HP2, and HP3) and one auxiliary pre-baking unit 70*s* (HPS) is in that while thermal processes are being performed for substrates G of a lot to be processed first in the pre-baking units 70*a*, 70*b*, and 70*c* (HP1, HP2, and HP3), the auxiliary pre-baking unit 70*s* (HPS) is set for the temperature of a thermal process for substrates G of a lot to be processed next and placed in a ready state for the substrates G. After the thermal processes for the substrates G of the lot to be processed first have been completed, the thermal process for the substrates G of the lot to be processed next is performed in the auxiliary pre-baking unit 70*s* (HPS).

On the other hand, the thermal process unit block 35 has four units of a passing unit 71 (PASS), a cooling unit 72 (COL), and two pre-baking units 70*e* and 70*d* (HP5 and HP4) that are vertically disposed in the order when viewed from the bottom. The passing unit 71 (PASS) transfers a substrate G with the adjacent unit. The cooling unit 72 (COL) cools a substrate G. The pre-baking units 70*e* and 70*d* (HP5 and HP4) perform pre-baking processes for substrates G.

The second transferring unit 36 receives a substrate G from the resist process unit 23 through the passing unit 69 (PASS), loads and unloads the substrate G among the thermal process units, transfers the substrate G with the developing process unit 24 (DEV) through the passing unit 71 (PASS), and transfers the substrate G with an extension cooling stage 44 (EXT. COL) that is a substrate transferring portion of the interface station 3 that will be described later. Since the second transferring unit 36 has the same structure as that of the first transferring unit 33, similar portions will be denoted by similar reference numerals and their description will be omitted. The second transferring unit 36 can access any units of the thermal process unit blocks 34 and 35.

In the second thermal process unit section 27, similar thermal process units are disposed in the pre-baking units 70*a* to 70*e* and the auxiliary pre-baking unit 70*s*. Next, in behalf of the pre-baking units 70*a* to 70*e*, the thermal process unit of the pre-baking unit 70*a* will be described.

Figure 7:
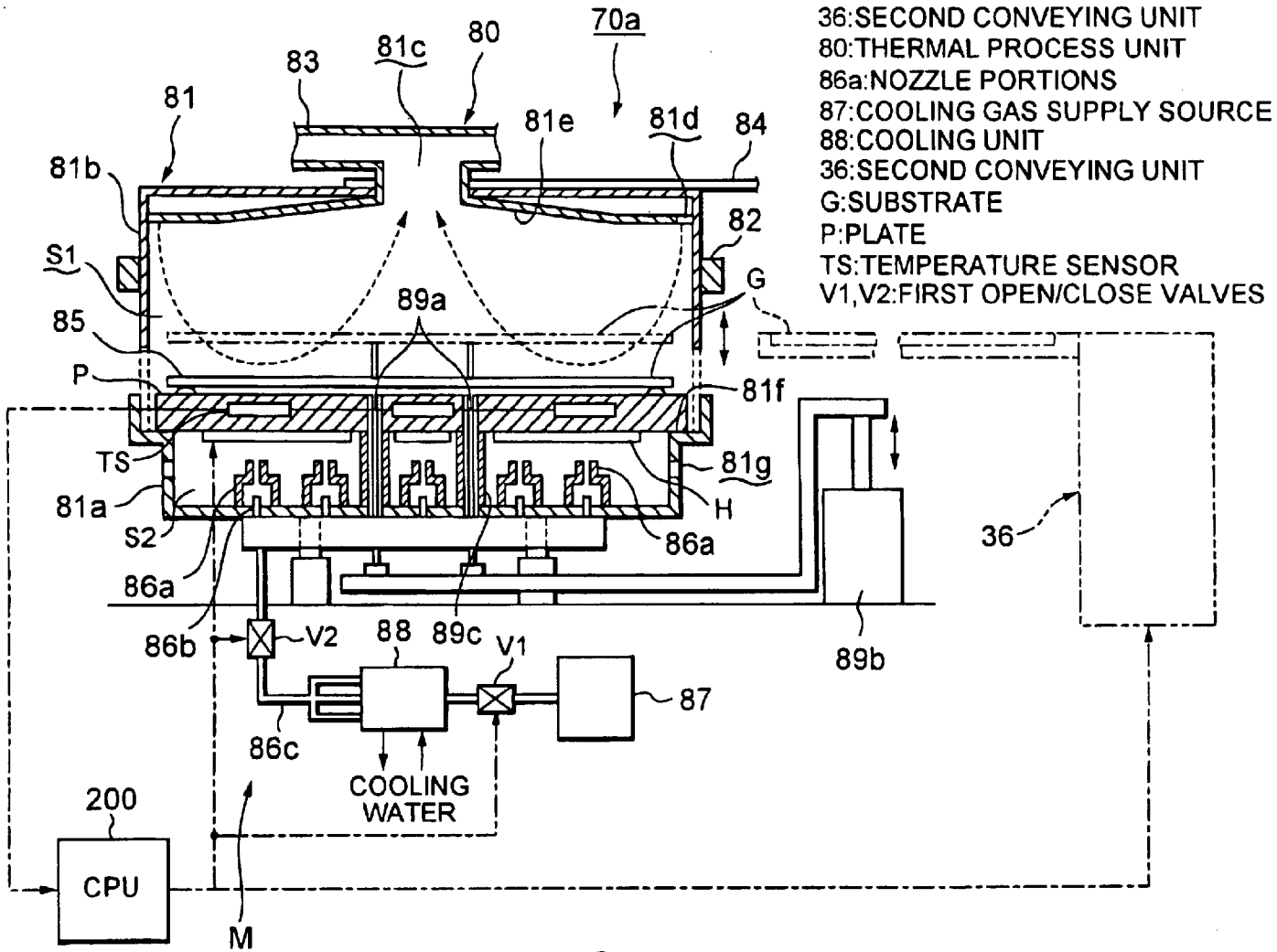
FIG. 7 is a sectional view showing main part of a thermal process apparatus.
Figure 8A:
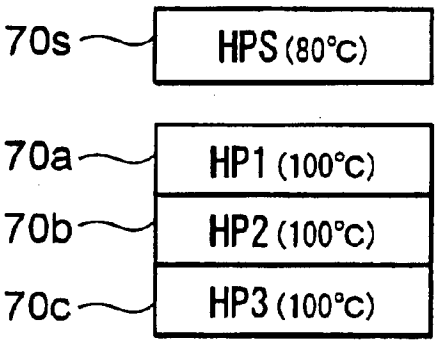
FIG. 8 is a view explaining a process method according to one embodiment of the present invention.
Figure 8B:
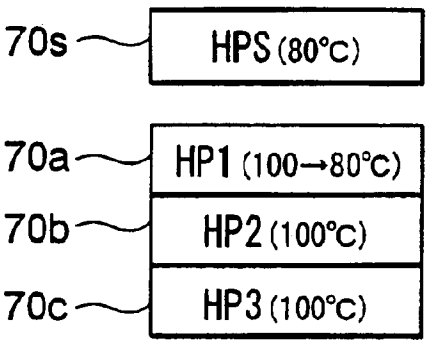
Figure 8C:
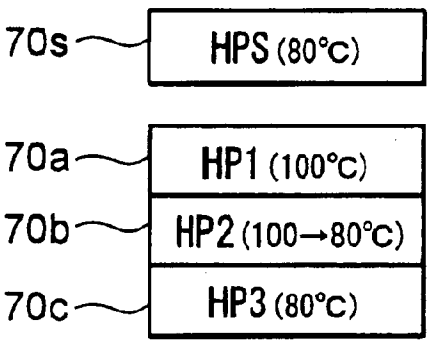
Figure 8D:
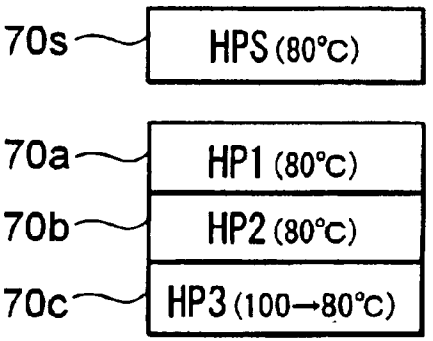
Figure 8E:
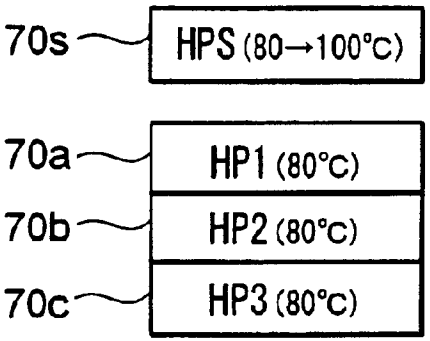
Figure 8F:
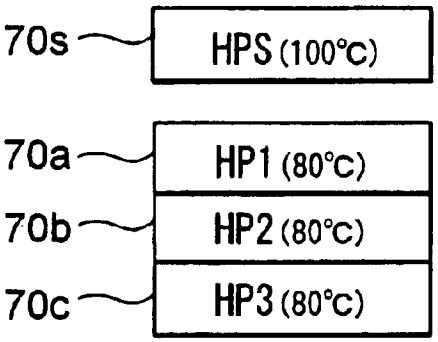
Figure 9A:
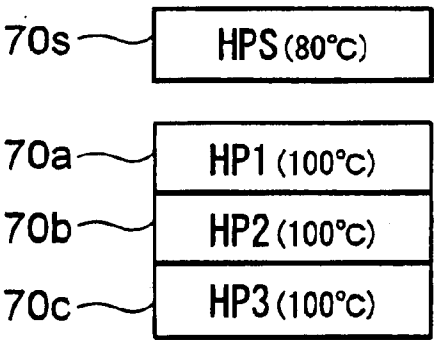
FIG. 9 is a block view explaining a process method according to another embodiment of the present invention.
Figure 9B:
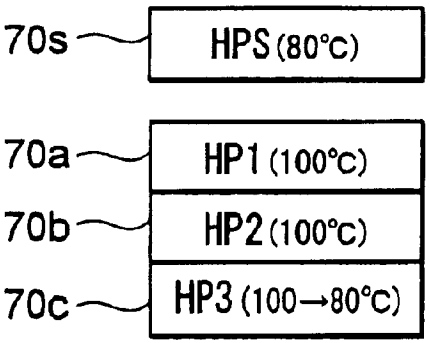
Figure 9C:
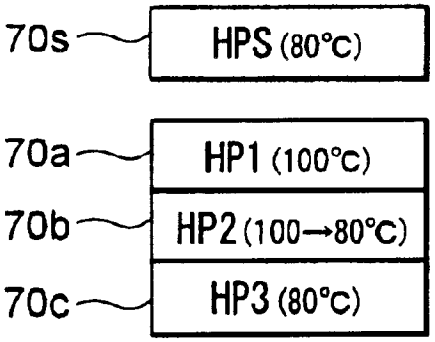
Figure 9D:
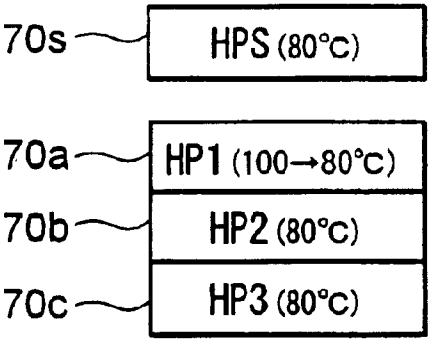
Figure 9E:
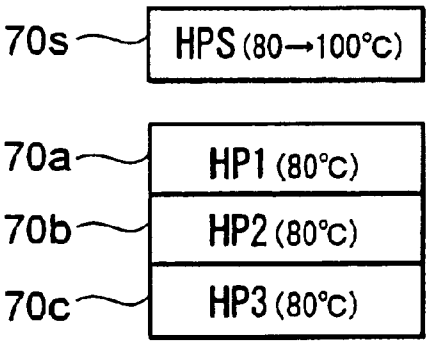
Figure 9F:
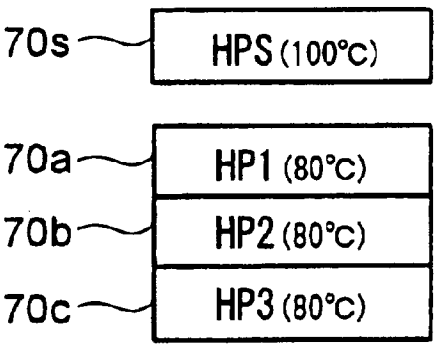

As shown in FIG. 7, the thermal process unit 80 has a plate P and a process vessel 81. The plate P is a holding table that holds a substrate G transferred by the second transferring unit 36. The process vessel 81 is composed of a lower vessel 81*a* and a lid 81*b*. The lower vessel 81*a* surrounds the lower portion and the periphery of the plate P. The lid 81*b* surrounds the periphery and the upper portion of the plate P.

The process vessel 81 is formed in a nearly quadrangular prism shape and composed of the lid 81*b* and the lower vessel 81*a* that are formed in square shapes. The lid 81*b* is disposed inside a side wall of the lower vessel 81*a* so as to form an internal air-tight space. Side portions of the lid 81*b* are supported by supporting arms 82. The lid 81*b* can be elevated by an elevating mechanism (not shown).

At the center of the lid 81*b*, an exhaust opening 81*c* is disposed. The exhaust opening 81*c* is connected to an exhaust pipe 83. Around the exhaust opening 81*c*, a plurality of gas supply holes 81*d* are formed in for example the peripheral direction of the lid 81*b*. In addition, the top portion of the lid 81*b* is inclined in such a manner that the height of the top portion gradually increases toward the center portion when viewed from the inside thereof. The gas supply holes 81*d* are formed at the outer periphery portion of the inclined portion 81*e* in the peripheral direction of the lid 81*b*. In addition, at the top portion of the lid 81*b*, a gas supply pipe 84 that supplies an inert gas such as nitrogen gas or argon gas as a purge gas is connected.

A shoulder portion 81*f* that protrudes inward is formed in the lower vessel 81*a*. A square plate P made of for example aluminum or ceramics is disposed on the shoulder portion 81*f* in such a manner that a peripheral region of the plate P is held by the shoulder portion 81*f*.

On the front surface of the plate P, a plurality of for example three proximity pins 85 made of for example ceramics protrude in such a manner that a substrate G is held at a height of for example 0.1 to 0.5 mm from the plate P. The reason why a substrate G is slightly raised from the plate P is in that the rear surface of the substrate G is prevented from being contaminated with particles. On the rear surface of the plate P, a heater H made of for example a nichrome wire or sintered metal as a heating means is disposed. With the heater H, the plate P is heated to a predetermined temperature.

The interior of the process vessel 81 is formed in such a manner that when the lid 81*b* is closed, two regions are formed below and above the plate P. A region surrounded by the plate P and the lid 81*b* becomes a heating process chamber S1, whereas a region surrounded by the plate P and the lower vessel 81*a* becomes a cooling chamber S2.

In the cooling chamber S2, a plurality of nozzle portions 86*a* that blows cooling gas for example air or nitrogen gas are disposed on the rear surface side of the plate P. A cooling gas supply pipe 86*b* is branched off cooling gas paths by a manifold M disposed on the outside of the lower vessel 81*a* and connected to the nozzle portions 86*a*. In addition, the manifold M is connected to a cooling gas supply source 87 through a cooling gas supply main pipe 86*c*. In that case, a first open/close valve V1, a cooling unit 88, and a second open/close valve V2 are disposed in succession when viewed from the cooling gas supply source 87 to the cooling gas supply main pipe 86*c*. With the first open/close valve V1, the flow rate of the cooling gas can be adjusted. The cooling unit 88 has a Peltier element as a cooling module. With the second open/close valve V2, the flow rate of the cooling gas can be adjusted. The nozzle portions 86*a*, the cooling unit 88, the cooling gas supply source 87, and so forth compose the cooling means.

Moreover, in the lower vessel 81*a*, a plurality of for example three elevating pins 89*a* are disposed. The elevating pins 89*a* elevate a substrate G when the second transferring unit 36 transfers the substrate G to the proximity pins 85. The elevating pins 89*a* pierce the cooling chamber S2 and the plate P. The elevating pins 89*a* are elevated by an elevating mechanism 89*b* disposed outside the process vessel 81. Furthermore, in the lower vessel 81*a*, a guide member 89*c* is disposed. The guide member 89*c* allows the elevating pins 89*a* to be elevated without disturbance of for example wiring of the heater H. A plurality of exhaust openings 81*g* for cooling gas are formed at proper positions of the side wall.

In the heating process chamber S1, purge gas as inert gas supplied from the gas supply pipe 84 through the gas supply holes 81*d* causes a heat atmospheric air flow denoted by dotted lines of the drawing (FIG. 7) to take place. In the cooling chamber S2, the cooling gas supply pipe 86*b* blows cooling gas to the rear surface side of the plate P through the nozzle portions 86*a*. As a result, the plate P is cooled to a predetermined temperature. In such a manner, the temperature of the plate P is adjusted.

In the plate P, a temperature sensor TS made of for example a thermocouple as a temperature detecting means is buried. A temperature detection signal that is output from the temperature sensor TS is sent to for example a controlling means for example a central processing unit 200 (hereinafter abbreviated as CPU 200). A control signal that is received from the CPU 200 is sent to the heater H, the first open/close valve V1, and the second open/close valve V2. In addition, the CPU 200 receives lot start/end information for substrates G to be processed corresponding to a detection signal of a substrate G presence/absence detection sensor (not shown) disposed in the cassette station 1 (loading and unloading portion) and stores the information. Corresponding to the control signal received from the CPU 200, the second transferring unit 36 is driven and controlled.

Thus, with the temperature detection signal of the temperature sensor TS and the control signal received from the CPU 200 corresponding to the signal detected by the sensor of the cassette station 1 (loading and unloading portion), the heater H, the first open/close valve V1, the second open/close valve V2, and the second transferring unit 36 are controlled. As a result, the temperature of the plate P can be changed between the process temperature for substrates G of a lot to be processed first and the process temperature for substrates G of a lot to be processed next. Consequently, substrates G can be transferred to the predetermined thermal process units namely the first to third pre-baking units 70*a* to 70*c* or the auxiliary thermal process unit namely the auxiliary pre-baking unit 70*s*. In those units, thermal processes can be performed for the substrates G.

Thus, when the thermal process units 80 are disposed in the pre-baking units 70*a* to 70*c* and the auxiliary pre-baking unit 70*s*, different thermal processes can be successively performed for individual lots of substrates G. For example, when a thermal process temperature condition for substrates G of a lot to be processed first is an optimum temperature for a pre-baking process for forming a resist film (for example 100° C.) and a thermal process temperature condition for substrates of a lot to be processed next is an optimum temperature for a pre-baking process for forming an insulating film (planarizing film) (for example 80° C.), the substrates G can be successively processed in the following processing method.

The forgoing embodiment describes the case that as a heating means of the thermal process unit 80, the heater H is used and as a cooling means thereof, cooling gas is used. However, it should be noted that the present invention is not limited to such a structure. For example, as a heating means, heat medium at a high temperature may be circulated in a flow path formed in the plate P and as a cooling mean, heat medium at a low temperature may be circulated in a flow path formed in the plate P.

Next, with reference to FIG. 8A to FIG. 8F, the forgoing processing method will be described. First of all, the plates P of the first to third pre-baking units 70*a* to 70*c* (HP1 to HP3) are set for a thermal process temperature for substrates G of a lot to be processed first, for example 100° C. The plate P of the auxiliary pre-baking unit 70*s* (HPS) is set for a thermal process temperature for substrates G of a lot to be processed next, for example 80° C. (see FIG. 8A). In that state, the second transferring unit 36 successively transfers (loads) substrates G to the plates P of the first to third pre-baking units 70*a* to 70*c* (HP1 to HP3) in the order from an upper unit to a lower unit. In the first to third pre-baking units 70*a* to 70*c* (HP1 to HP3), thermal processes are performed for the substrate G. After the thermal processes for the substrate G have been completed, the substrates G are unloaded from the first to third pre-baking units 70*a* to 70*c* (HP1 to HP3) and transferred to the next process portion by the second transferring unit 36.

In such a manner, the thermal processes are performed in the first to third pre-baking units 70*a* to 70*c* (HP1 to HP3). The last substrate G of the lot is loaded to the third pre-baking unit 70*c* (HP3). In the third pre-baking unit 70*c* (HP3), the thermal process is performed for the substrate G. The first substrate G of the lot to be processed next is loaded to the auxiliary pre-baking unit 70*s* (HPS). In the auxiliary pre-baking unit 70*s* (HPS), the thermal process is performed for the substrate G at a temperature of 80° C. (see FIG. 8B). During that, the third last substrate G of the lot to be processed first is unloaded from the first pre-baking unit 70*a* (HP1) by the second transferring unit 36. In other words, when the last substrate G of the lot to be processed first is unloaded from the first pre-baking unit 70*a* (HP1), the heater H is controlled to a low temperature side corresponding to a control signal received from the CPU 200. In addition, the first open/close valve V1 and the second open/close valve V2 are opened. Thus, cooling gas is supplied to the plate P of the first pre-bake unit 70*a* (HP1). As a result, the temperature of the plate P of the first pre-baking unit 70*a* is changed from 100° C. to 80° C. (see FIG. 8B). In that state, the second substrate G of the lot to be processed next is loaded to the first pre-baking unit 70*a* (HP1) by the second transferring unit 36. In the first pre-bake unit 70*a* (HP1), the thermal process is performed for the substrate G at a temperature of 80° C.

Thereafter, the second last substrate G of the lot to be processed first is unloaded from the second pre-baking unit 70*b* (HP2). Likewise, the temperature of the plate P of the second pre-baking unit 70*b* (HP2) is changed from 100° C. to 80° C. (see FIG. 8C). In that state, the third substrate G of the lot to be processed next is loaded to the second pre-baking unit 70*b* (HP2) by the second transferring unit 36. In the second pre-baking unit 70*b* (HP2), the thermal process is performed for the substrate G at a temperature of 80° C. Thereafter, the last substrate G of the lot to be processed first is unloaded from the third pre-baking unit 70*c* (HP3). Likewise, the temperature of the plate P of the third pre-baking unit 70*c* (HP3) is changed from 100° C. to 80° C. (see FIG. 8D). In that state, the fourth substrate G of the lot to be processed next is loaded to the third pre-baking unit 70*c* (HP3) by the second transferring unit 36. In the third pre-baking unit 70*c* (HP3), the thermal process is performed for the substrate G at a temperature of 80° C. In that state, in all the first to third pre-baking units 70*a* to 70*c* (HP1 to HP3), the thermal processes are performed for the second to fourth substrates G of the lot to be processed next at a temperature of 80° C. The fifth and later substrates G are successively loaded to the first to third pre-baking units 70*a* to 70*c* (HP1 to HP3). In the first to third pre-baking units 70*a* to 70*c* (HP1 to HP3), the thermal processes are performed for the substrates G. During that, the first substrate G of the lot to be processed next is unloaded from the auxiliary pre-baking unit 70*s* (HPS) by the second transferring unit 36. Thereafter, the heater H of the auxiliary pre-baking unit 70*s* (HPS) is controlled to a higher temperature side corresponding to a control signal received from the CPU 200. In addition, the first open/close valve V1 and the second open/close valve V2 are closed. Thus, cooling gas is stopped. As a result, the temperature of the plate P of the auxiliary pre-baking unit 70*s* (HPS) is changed from 80° C. to 100° C. The auxiliary pre-baking unit 70*s* (HPS) is placed in a ready state for processing substrates G of the lot to be processed next (see FIGS. 8E and F).

In such a manner, while substrates G of the lot to be processed first are being transferred to the pre-baking units 70*a* to 70*c* (HP1 to HP3) as the first process portion and the thermal processes are being performed for the substrates G therein, the auxiliary pre-baking unit 70*s* (HPS) as the second process portion is set for a process condition (80° C.) for substrates G of the lot to be processed next and placed in a ready state for processing the substrates G. After the processes of the pre-baking units 70*a* to 70*c* (HP1 to HP3) (first process portion) have been completed, substrates G of the lot to be processed next can be transferred to the auxiliary pre-baking unit 70*s* (HPS) (second process portion) and the thermal process can be performed for the substrates G therein. Alternatively, while the thermal process is being performed for substrates G in the auxiliary pre-baking unit 70*s* (HPS) (second process portion), the pre-baking units 70*a* to 70*c* (HP1 to HP3) (first process portion) may be set for the same process condition (80° C.) as that of the auxiliary pre-baking unit 70*s* (HPS) (second process portion). Substrates G of the lot to be processed next may be transferred to the first to third pre-baking units 70*a* to 70*c* (HP1 to HP3) (first process portion) whose process conditions have been changed and the thermal processes may be performed for the substrates G therein. Alternatively, after the thermal process of the auxiliary pre-baking unit 70*s* (HPS) (second process portion) has been completed, it may be set for a process condition (for example, 100° C.) for substrates G of a lot to be processed after the next and placed in a ready state for processing the substrates G. Likewise, the first to third pre-baking units 70*a* to 70*c* (HP1 to HP3) (first process portion) and the auxiliary pre-baking unit 70*s* (HPS) (second process portion) are changed to a process condition for substrates G of the lot to be processed next. As a result, thermal processes can be successively performed for substrates G of a plurality of lots in different process conditions. Thus, when only one auxiliary pre-baking unit 70*s* (HPS) (second process portion) is added, thermal processes can be successively performed for substrates G of a plurality of lots in different process conditions.

The forgoing description describes the case that the temperatures of the first to third pre-baking units 70*a* to 70*c* (HP1 to HP3) (first process portion) and the temperature of the auxiliary pre-baking unit 70*s* (HPS) (second process portion) are simultaneously set. Alternatively, the temperature of the auxiliary pre-baking unit 70*s* (HPS) (second process portion) may be set while thermal processes are being performed for substrates G of the lot to be processed first in the pre-baking units 70*a* to 70*c* (HP1 to HP3) (first process portion).

In that case, a table that contains time information about temperature changes is prepared and stored. The time necessary for the temperature change for the auxiliary pre-baking unit 70*s* (HPS) is read from the table. At that point, since the process end time of the last substrate of the lot to be processed first is calculated by the CPU 200, the temperature of the auxiliary pre-baking unit 70*s* (HPS) can be changed before the calculated time. Thus, when the changing timing of the auxiliary pre-baking unit 70*s* (HPS) is as late as possible in the range of the calculated time, like the pre-baking units 70*a* to 70*c*, the auxiliary pre-baking unit 70*s* can be used for the process for the lot to be processed first until the temperature changing timing.

The forgoing embodiment describes the case that one auxiliary pre-baking unit 70*s* (HPS) (second process portion) is used. However, as long as at least one auxiliary pre-baking unit 70*s* (HPS) (second process portion) is used, a plurality of for example two auxiliary pre-baking units 70*s* (HPS) may be used.

When it takes a long time to change the pre-baking units 70*a* to 70*c* from a first process temperature to a second process temperature, until the process temperatures have been changed, the thermal process is performed in only the auxiliary pre-baking unit 70*s*. After the temperatures of the pre-baking units 70*a* to 70*c* (HP1 to HP3) have been changed, of course the thermal processes can be performed in the pre-baking units 70*a* to 70*c* (HP1 to HP3). In that case, although the throughput of the units is lowered, thermal processes can be successively performed for substrates G of a plurality of lots.

Figure 6:
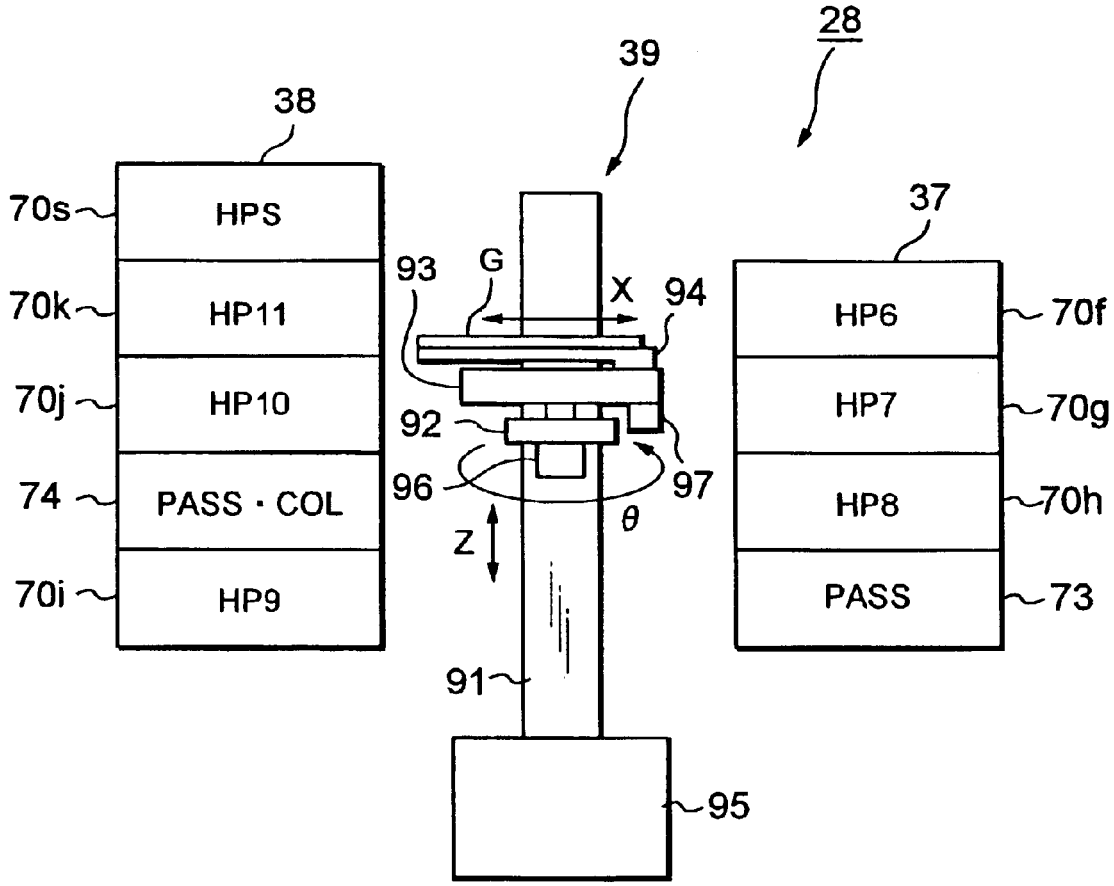
FIG. 6 is a side view showing a third thermal process unit section.

The third thermal process unit section 28 has two thermal process unit blocks 37 and 38 (TB). Each of the thermal process unit blocks 37 and 38 (TB) has thermal process units that perform thermal processes for substrates G and that are vertically disposed. The thermal process unit block 37 (TB) is disposed on the developing process unit 24 (DEV) side. The thermal process unit block 38 (TB) is disposed adjacent to the cassette station 1. A third transferring unit 39 as a transferring means is disposed between the two thermal process unit blocks 37 and 38 (TB). As shown with a side view of FIG. 6, the thermal process unit block 37 (TB) has four units of a passing unit 73 (PASS), three post-baking units 70*h*, 70*g*, and 70*f* (HP8, HP7, and HP6) that are vertically disposed in the order when viewed from the bottom. The passing unit 73 (PASS) transfers a substrate G with the adjacent unit. The post-baking units 70*h*, 70*g*, and 70*f* (HP8, HP7, and HP6) perform post-baking processes for substrates G. The thermal process unit block 38 (TB) has five units of a post-baking unit 70*i* (HP9), a passing and cooling unit 74 (PASS.COL), two post-baking units 70*j* and 70*k* (HP10 and HP11), and an auxiliary pre-baking unit 70*s* (HPS) that are vertically disposed in the order when viewed from the bottom. The passing and cooling unit 74 (PASS.COL) transfers a substrate G with the adjacent unit and cools the substrate G. The post-baking units 70*j* and 70*k* (HP10 and HP11) perform post-baking processes for substrates G.

The third transferring unit 39 receives a substrate G from the i-ray UV radiating unit 25 (i-UV) through the passing unit 73 (PASS), loads and unloads the substrate G among the thermal process units, and transfers the substrate G with the cassette station 1 through the passing and cooling unit 74 (PASS.COL). The third transferring unit 39 has the same structure as the first transferring unit 33. The third transferring unit 39 can access any units of the thermal process unit blocks 37 and 38 (TB).

Thus, like the second thermal process unit section 27, the third thermal process unit section 28 can successively perform thermal processes for substrates G of a plurality of lots in different process conditions (temperature conditions).

Substrates G are loaded to the scrub cleaning process unit 21 (SCR) and the excimer UV radiating unit 22 (e-UV) by the transferring unit 11 of the cassette station 1. A substrate G is unloaded from the scrub cleaning process unit 21 (SCR) and loaded to the passing unit 61 of the thermal process unit block 31 (TB) by for example the forgoing roller transferring mechanism. The substrate G is raised by protrusion pins (not shown) and transferred by the first transferring unit 33. When a substrate G is loaded to the resist process unit 23, after the substrate G has been transferred to the passing unit 65 (PASS) by the first transferring unit 33, the substrate G is loaded through the loading opening 57 by the sub arms 56. In the resist process unit 23, the substrate G is transferred to the passing unit 69 (PASS) of the thermal process unit block 34 through the unloading opening 58 by the sub arms 56. The substrate G is placed on protrusion pins (not shown). When a substrate G is loaded to the developing process unit 24 (DEV), in the passing unit 73 (PASS) of the thermal process unit block 35, the substrate G is raised and lowered by protrusion pins (not shown). As a result, for example a roller transferring mechanism that extends to the passing unit 73 (PASS) is operated. A substrate G is unloaded from the i-ray UV radiating unit 25 (i-UV) and loaded to the passing unit 73 (PASS) of the thermal process unit block 37 (TB) by for example a roller transferring mechanism. The substrate G is raised by protrusion pins (not shown). The raised substrate G is transferred by the third transferring unit 39. After all the processes for a substrate G have been completed, the substrate G is transferred to the passing and cooling unit 74 (PASS. COL) of the thermally processing unit block 38 (TB). Thereafter, the substrate G is unloaded by the transferring unit 11 of the cassette station 1.

In the process station 2, process units and transferring units are disposed in such a manner that the two transferring lines A and B are structured and processes are performed in the forgoing order. A space portion 40 is formed between the transferring lines A and B. A shuttle 41 (substrate holding member) that reciprocates is disposed in the space portion 40. The shuttle 41 is structured so that it can hold a substrate G and transfer the substrate G between the lines A and B.

The interface station 3 has a transferring unit 42, a buffer stage (BUF) 43, and an extension cooling stage 44 (EXT.COL). The transferring unit 42 loads and unloads a substrate G between the process station 2 and the exposing unit 4. On the buffer stage (BUF) 43, a buffer cassette is placed. The extension cooling stage 44 (EXT.COL) is a substrate transferring portion that has a cooling function. An external unit block 45 is disposed adjacent to the transferring unit 42. The external unit block 45 has a titler and a peripheral exposing unit (EE) that are vertically disposed. The transferring unit 42 has a transferring arm 42*a*. The transferring arm 42*a* loads and unloads a substrate G between the process station 2 and the exposing unit 4.

In the resist coating and developing process system 100, a substrate G contained in a cassette C placed on the cassette station 1 is directly loaded to the excimer UV radiating unit 22 (e-UV) of the process station 2 by the transferring unit 11. In the excimer UV radiating unit 22 (e-UV), a pre-scrub process is performed for the substrate G. Thereafter, the substrate G is loaded to the scrub cleaning process unit 21 (SCR) disposed below the excimer UV radiating unit 22 (e-UV) by the transferring unit 11. In the scrub cleaning process unit 21 (SCR), the substrate G is scrub-cleaned. Unlike in the conventional system, in the scrub-cleaning process, while the substrate G is being almost horizontally transferred, not rotated, a cleaning process and a drying process are performed for the substrate G. Thus, the scrub cleaning process unit 21 (SCR) can accomplish the same process performance as that two conventional rotating type scrubber cleaning process units do in a smaller space than those. After the scrub-cleaning process has been performed for the substrate G, it is transferred to the passing unit 61 of the thermal process unit block 31 (TB) of the first thermal process unit section 26 by for example a roller transferring mechanism.

The substrate G placed in the passing unit 61 is raised by protrusion pins (not shown). Thereafter, the raised substrate G is transferred to the first thermal process unit section 26. In the first thermal process unit section 26, a sequence of processes are performed. First of all, the substrate G is transferred to one of the dehydrating and baking units 62 and 63 (DHP) of the thermal process unit block 31 (TB). In the dehydrating and baking unit 62 or 63 (DHP), a thermal process is performed for the substrate G. Thereafter, the substrate G is transferred to one of the cooling units 66 and 67 (COL) of the thermal process unit block 32 (TB). In the cooling unit 66 or 67 (COL), a cooling process is performed for the substrate G. Thereafter, to improve fixation of resist, the substrate G is transferred to one of the adhesion process unit 64 (AD) of the thermal process unit block 31 (TB) and the adhesion process unit 68 (AD) of the thermal process unit block 32 (TB). In the adhesion process unit 64 or 68 (AD), an adhesion process (hydrophobic process) is performed for the substrate G with HMDS (hexamethyldisilazane). Thereafter, the substrate G is transferred to one of the cooling units 66 and 67 (COL). In the cooling unit 66 or 67 (COL), the substrate G is cooled. Thereafter, the substrate G is transferred to the passing unit 65 (PASS) of the thermal process unit block 32 (TB). Those transferring processes are performed by only the first transferring unit 33. When the adhesion process is not performed, the substrate G is dehydrated, baked, and cooled. Thereafter, the substrate G is directly transferred to the passing unit 65 (PASS).

Thereafter, the substrate G placed in the passing unit 65 (PASS) is loaded to the resist process unit 23 by the sub arms 56 of the resist process unit 23. The substrate G is transferred to the resist coating process unit 23*a* (CT) of the resist process unit 23. In the resist coating process unit 23*a* (CT), resist solution is spin-coated to the substrate G. Thereafter, the substrate G is transferred to the reduced pressure drying unit 23*b* (VD) by the sub arms 56. In the reduced pressure drying unit 23*b* (VD), the substrate G is dried in reduced pressure. Thereafter, the substrate G is transferred to the periphery resist removing unit 23*c* (ER) by the sub arms 56. In the periphery resist removing unit 23*c* (ER), excessive resist is removed from the periphery of the substrate G. After the excessive resist has been removed from the periphery of the substrate G, it is unloaded from the resist process unit 23 by the sub arms 56. The reason why the reduced pressure drying unit 23*b* (VD) is disposed downstream of the resist coating process unit 23*a* (CT) is in that if the reduced pressure drying unit 23*b* (VD) is not disposed, after a resist-coated substrate G is pre-baked or a developed-substrate G is post-baked, marks of list pins, fixing pins, or the like will be transferred to a substrate G. However, when a substrate G is dried in reduced pressure by the reduced pressure drying unit 23*b* (VD), solvent is gradually given off from the resist. Thus, the substrate G is not quickly dried unlike the case that it is heated and dried. Consequently, without adverse influence on the resist, it can be properly dried. As a result, marks can be prevented from being transferred to a substrate.

When the coating process has been completed, a substrate G is unloaded from the resist process unit 23 by the sub arms 56. The substrate G is transferred to the passing unit 69 (PASS) of the thermal process unit block 34 (TB) of the second thermal process unit section 27. The substrate G placed in the passing unit 69 (PASS) is transferred to one of the pre-baking units 70*a* to 70*c* (HP1 to HP3) of the thermal process unit block 34 and the pre-baking units 70*d* and 70*e* (HP4 and HP5) of the thermal process unit block 35. In the pre-baking unit 70*a* to 70*c*, 70*d*, or 70*e*, a pre-baking process is performed for the substrate G. Thereafter, the substrate G is transferred to the cooling unit 72 (COL) of the thermal process unit block 35 (TB). In the cooling unit 72 (COL), the substrate G is cooled to a predetermined temperature. Thereafter, the substrate G is transferred to the passing unit 71 (PASS) of the thermal process unit block 35 (TB) by the second transferring unit 36

Thereafter, the substrate G is transferred to the extension cooling stage 44 (EXT.COL) of the interface station 3 by the second transferring unit 36. Thereafter, the substrate G is transferred to the peripheral exposing unit (EE) of the external unit block 45 by the transferring unit 42 of the interface station 3. In the peripheral exposing unit (EE), to remove peripheral resist from the substrate G, it is exposed. Thereafter, the substrate G is transferred to the exposing unit 4 by the transferring unit 42. In the exposing unit 4, a resist film of the substrate G is exposed. As a result, a predetermined pattern is formed on the substrate G. When necessary, the substrate G is contained in a buffer cassette on the interface station 3. Thereafter, the buffer cassette, which contains the substrate G, is transferred to the exposing unit 4.

After the resist film of the substrate G has been exposed, the substrate G is loaded to the titler disposed as an upper unit in the external unit block 45 by the transferring unit 42 of the interface station 3. In the titler, predetermined information is written on the substrate G. Thereafter, the substrate G is placed on the extension cooling stage 44 (EXT.COL). Thereafter, the substrate G is loaded from the extension cooling stage 44 (EXT.COL) to the process station 2 again. In other words, the substrate G is transferred to the passing unit 71 (PASS) of the thermal process unit block 35 of the second thermal process unit section 27 by the second transferring unit 36. In the passing unit 71 (PASS), the substrate G is raised and lowered by protrusion pins. As a result, for example a roller transferring mechanism that extends from the developing process unit 24 (DEV) to the pass unit 71 (PASS) is operated. By the roller transferring mechanism, the substrate G is loaded to the developing process unit 24 (DEV). In the developing process unit 24 (DEV), a developing process is performed for the substrate G. Unlike in the conventional system, in the developing process, while the substrate G is being almost horizontally transferred not rotated by for example a roller transferring mechanism, a developing-solution coating process, a developing process, a developing-solution removing process, and a drying process are performed. Thus, the developing process unit 24 (DEV) can accomplish the same process performance as that of three conventional rotating type development process units do in a smaller space than those.

After the developing process has been completed, the substrate G is transferred to the i-ray UV radiating unit 25 (i-UV) by a transferring mechanism for example a roller transferring mechanism that continues from the developing process unit 24 (DEV). In the i-ray UV radiating unit 25 (i-UV), a discoloring process is performed for the substrate G. Thereafter, the substrate G is transferred to the passing unit 73 (PASS) of the thermal process unit block 37 (TB) of the third thermal process unit section 28 by a transferring mechanism for example a roller transferring mechanism of the i-ray UV radiating unit 25 (i-UV).

The substrate G placed in the passing unit 73 (PASS) is transferred to one of the post-baking units 70*f* to 70*h* (HP6 to HP8) of the thermal process unit block 37 (TB) and the post-baking units 70*i* to 70*k* (HP9 to HP11) of the thermal process unit block 38 (TB) by the third transferring unit 39. In the post-baking unit 70*f* to 70*k*, a post-baking process is performed for the substrate G. Thereafter, the substrate G is transferred to the passing and cooling unit 74 (PASS.COL) of the thermal process unit block 38 (TB). In the passing and cooling unit 74 (PASS.COL), the substrate G is cooled to a predetermined temperature. Thereafter, the substrate G is accommodated to a predetermined cassette C placed on the cassette station 1 by the transferring unit 11 of the cassette station 1.

As was described above, the scrub cleaning process unit 21 (SCR), the resist process unit 23, and the developing process unit 24 (DEV) are structured in such a manner that while substrates G are being almost horizontally transferred, predetermined solution processes are performed for the substrates G. The processes are performed in the order and the two transferring lines for substrates G are arranged. While substrates G are being transferred along the two parallel transferring lines A and B, those processes are successively performed. Thus, a high throughput can be kept. In addition, a large central transferring unit that travels among a plurality of process units and a central transferring path on which the central transferring unit travels can be basically omitted unlike the conventional system. Thus, the space necessary for a central transferring unit and a central transferring path can be omitted. As a result, the footprint can be decreased. Moreover, in the scrub cleaning process unit 21 (SCR) and the developing process unit 24 (DEV), while substrates G are being horizontally transferred, not rotated, processes are performed. In other words, so-called flat transferring system is used. Thus, mist that occurs in the case that a substrate G is rotated can be reduced.

Moreover, for solution process units of the scrub cleaning process unit 21 (SCR), the resist process unit 23, and the developing process unit 24 (DEV), a plurality of thermal process units are centralized as the first to third thermal process unit sections 26, 27, and 28. In addition, those thermal process units are vertically disposed as thermal process unit blocks (TB). Thus, the footprint can be further reduced. Moreover, substrates G are transferred along thermal process units in as a short distance as possible. Thus, the throughput of the units can be further improved. In addition, since the first to third transferring units 33, 36, and 39 are disposed corresponding to the first, second, and third thermal process unit sections 26, 27, and 28, the throughput of the units can be further improved.

Although a basic process pattern has been described, according to the forgoing embodiment, in the process station 2, the space portion 40 is formed between the two transferring lines A and B. Since the shuttle 41, which reciprocates in the space portion 40, is disposed, besides such a basic process pattern, various process patterns can be performed. Thus, the degree of freedom of the processes is high.

When it is necessary to perform only a resist process, it can be performed in the following procedure. First of all, the shuttle 41 is traveled to a position adjacent to the cassette station 1. Thereafter, one substrate G is taken out of a cassette C by the transferring unit 11. The substrate G is placed on the shuttle 41. The shuttle 41 is traveled to the position of the first transferring unit 33. The substrate G placed on the shuttle 41 is transferred to one of the adhesion process units 64 and 68 (AD). After an adhesion process has been performed for the substrate G in the adhesion process unit 64 or 68 (AD), the substrate G is cooled in the cooling unit 66 or 67 (COL) and then loaded to the resist process unit 23 through the passing unit 65 (PASS) of the thermal process unit block 32 (TB). In the resist process unit 23, the substrate G is loaded to the periphery resist removing unit 23*c* (ER). In the periphery resist removing unit 23*c* (ER), a resist removing process is performed for the substrate G. Thereafter, the substrate G is transferred to the passing unit 69 (PASS) of the thermal process unit block 34. Thereafter, the substrate G is placed on the shuttle 41 by the second transferring unit 36. Thereafter, the shuttle 41 is returned to the cassette station 1. When the adhesion process is not performed, the first transferring unit 33 that has received a substrate G from the shuttle 41 directly transfers the substrate G to the passing unit 65 (PASS).

When it is necessary to perform only a developing process, it can be performed in the following procedure. First of all, the shuttle 41 that has received a substrate G from the cassette station 1 is traveled to the position of the second transferring unit 36. The substrate G on the shuttle 41 is transferred to the developing process unit 24 (DEV) through the passing unit 73 (PASS) of the thermal process unit block 35 by the second transferring unit 36. After a developing process of the developing process unit 24 (DEV) and a discoloring process of the i-ray UV radiating unit 25 (i-UV) have been performed, the substrate G is transferred to the passing unit 73 (PASS) of the thermal process unit block 37 (TB). The substrate G is placed on the shuttle 41 by the third transferring unit 39. The shuttle 41 is returned to the cassette station 1.

When the shuttle 41 is not used, it is kept at an end portion of the space portion 40. Thus, the space portion 40 can be used as a maintenance space.

Unlike a conventional central transferring unit, since the shuttle 41 only holds an unprocessed substrate and travels, a large mechanism is not required. Thus, a large space for a central transferring path on which the conventional central transferring unit travels is not required. Consequently, the shuttle 41 does not deteriorate the saved space effect.

The forgoing embodiment describes the case that workpieces are LCD glass substrates. However, according to the present invention, workpieces are not limited to LCD glass substrates. The present invention can be applied to for example semiconductor wafers, CDs, and so forth.

In addition, the forgoing embodiment describes the case that thermal processes are performed for workpieces. However, the present invention is not limited to thermal processes. Alternatively, the present invention can be applied to cooling processes or processes in different processing atmospheres.

The pre-bake temperatures of the first to third pre-baking units 70*a* to 70*c* (HP1 to HP3) are not limited to 80° C. When an insulating film (planarizing film) is formed, the pre-baking temperature may be in the range from 80° C. to 90° C. As described above, when a positive type resist film is formed, the pre-baking temperature is 100° C. However, in that case, the pre-baking temperature may exceed 100° C. When an insulating film (planarizing film) is formed, the post-baking temperature is 300° C. When a positive type resist film is formed, the post-baking temperature is 130° C.

In the forgoing embodiment, "insulating film (planarizing film)" is an insulating film used to planarize the surface of a substrate. The material of the insulating film is a liquefied acrylic resin that has photo-sensitivity. When the insulating film is exposed and developed and through-holes are formed on the insulating film, devices disposed on the upper and lower layers of the insulating film can be connected with wires.

In the cooling chamber S2, cooling gas is blown to the rear surface side of the plate P. As a result, the plate P is cooled to a predetermined temperature. In such a manner, the temperature of the plate P is adjusted. Thus, when the temperature of the plate P is changed for example from 100° C. to 80° C., if the plate P is quickly cooled, one unit can quickly and successively perform a thermal process for different films. However, if the plate P is quickly cooled or heated, the thermal change damages the plate P, for example, it cracks. Particularly, in recent years, as glass substrates are becoming large, the plate P is becoming large. Thus, the plate P tends to be adversely affected by heat. Consequently, it is not preferred to quickly cool and heat the plate P. According to the forgoing embodiment, however, with only one auxiliary pre-baking unit 70*s* (HPS) added, substrates G can be successively processed.

Next, another embodiment of the present invention will be described. With reference to FIG. 9, a processing method according to the embodiment will be described. First of all, the plates P of the first to third pre-baking units 70*a* to 70*c* (HP1 to HP3) are set for a thermal process temperature for substrates G of a lot to be processed first for example 100° C. The plate P of the auxiliary pre-baking unit 70*s* (HPS) is set for a thermal process temperature for substrates G of a lot to be processed next for example 80° C. (see FIG. 9A). In that state, substrates G are successively transferred (loaded) to the plates P of the first to third pre-baking units 70*a* to 70*c* (HP1 to HP3) in the order from a lower unit to an upper unit by the second transferring unit 36. In the first to third pre-baking units 70*a* to 70*c* (HP1 to HP3), thermal processes are performed for the substrates G on the plates P thereof. After the thermal processes have been performed for the substrates G, they are unloaded from the first to third pre-baking units 70*a* to 70*c* (HP1 to HP3) and transferred to the next process portion.

In such a manner, the thermal processes are performed in the first to third pre-baking units 70*a* to 70*c* (HP1 to HP3). The last substrate G of the lot is loaded to the first pre-baking unit 70*a* (HP1). In the first pre-baking unit 70*a* (HP1), the thermal process is performed for the substrate G. The first substrate G of a lot to be processed next is loaded to the auxiliary pre-baking unit 70*s* (HPS). In the auxiliary pre-baking unit 70*s* (HPS), the thermal process is performed for the substrate G at a temperature of 80° C. (see FIG. 9B). During that, the third last substrate G of the lot to be processed first is unloaded from the third pre-baking unit 70*c* (HP3) by the second transferring unit 36. In other words, when the last substrate G of the lot to be processed first is unloaded from the third pre-baking unit 70*c* (HP3), the heater H is controlled to a low temperature side corresponding to a control signal received from the CPU 200. In addition, the first and second open/close valves V1 and V2 are opened and cooling gas is supplied to the plate P. As a result, the temperature of the plate P of the third pre-baking unit 70*c* (HP3) is changed from 100° C. to 80° C. (see FIG. 9B). In that state, the second substrate G of the lot to be processed next is loaded to the third pre-baking unit 70*c* (HP3) by the second transferring unit 36. In the third pre-baking unit 70*c* (HP3), the thermal process is performed for the substrate G at a temperature of 80° C.

Next, the second last substrate G of the lot to be processed first is unloaded from the second pre-baking unit 70*b* (HP2). At that point, likewise, the temperature of the plate P of the second pre-baking unit 70*b* (HP2) is changed from 100° C. to 80° C. (see FIG. 9C). In that state, the third substrate G of the lot to be processed next is loaded to the second pre-baking unit 70*b* (HP2) by the second transferring unit 36. In the second pre-baking unit 70*b* (HP2), the thermal process is performed for the substrate G at a temperature of 80° C.

When the last substrate G of the lot to be processed first is unloaded from the first pre-baking unit 70*a* (HP1), likewise, the temperature of the plate P of the first pre-baking unit 70*a* (HP1) is changed form 100° C. to 80° C. (see FIG. 9D). In that state, the fourth substrate G of the lot to be processed next is loaded to the first pre-baking unit 70*a* (HP1) by the second transferring unit 36. In the first pre-baking unit 70*a* (HP1), the thermal process is performed for the substrate G at a temperature of 80° C. In that state, in all the pre-baking units 70*a* to 70*c* (HP1 to HP3), the thermal processes are performed for all the second to fourth substrates G of the lot to be processed next at a temperature of 80° C. The fifth and later substrates G are successively loaded to the first to third pre-baking units 70*a* to 70*c* (HP1 to HP3) in the order from a lower unit to an upper unit. In the first to third pre-baking units 70*a* to 70*c* (HP1 to HP), the thermal processes are performed for the fifth and later substrates G. During that, the first substrate G of the lot to be processed next is unloaded from the auxiliary pre-baking unit 70*s* (HPS) by the second transferring unit 36. Thereafter, the heater H of the auxiliary pre-baking unit 70*s* (HPS) is controlled to a high temperature side corresponding to a control signal received from the CPU 200. In addition, the first and second open/close valves V1 and V2 are closed and cooling gas is stopped. The temperature of the plate P of the auxiliary pre-baking unit 70*s* (HPS) is changed for example from 80° C. to 100° C. The auxiliary pre-baking unit 70*s* (HPS) is placed in a ready state for processing substrates G of a lot to be processed after the next (see FIGS. 9E and 9F).

As described above, while substrates G of the lot to be processed first are being loaded to the first to third pre-baking units 70*a* to 70*c* (HP1 to HP3) as the first process portion and their thermal processes are being performed therefor, the auxiliary pre-baking unit 70*s* (HPS) as the second process portion is set for a process condition (80° C.) for substrates G of a lot to be processed next and placed in a ready state for processing them. After the processes of the first to third pre-baking units 70*a* to 70*c* (HP1 to HP3) (first process portion) have been completed, substrates G of the lot to be processed next can be loaded to the auxiliary pre-baking unit 70*s* (HPS) (second process portion). In the auxiliary pre-baking unit 70*s* (HPS), the thermal process is performed for the substrates G. While the substrates G are being processed in the auxiliary pre-baking unit 70*s* (HPS) (second process portion), the first to third pre-baking units 70*a* to 70*c* (HP1 to HP3) (first process portion) are changed to the same process condition (80° C.) as that of the auxiliary pre-baking unit 70*s* (HPS) (second process portion). Substrates G of the lot to be processed next are loaded to the first to third pre-baking units 70*a* to 70*c* (HP1 to HP3) whose process conditions have been changed. In the first to third pre-baking units 70*a* to 70*c* (HP1 to HP3), the thermal processes are performed for the substrates G. After the thermal process of the auxiliary pre-baking unit 70*s* (HPS) (second process portion) has been completed, the auxiliary pre-baking unit 70*s* (HPS) (second process portion) may be changed to a process condition (100° C.) for substrates G of a lot to be processed after the next and placed in a ready state for processing the substrates G. Likewise, the first to third pre-baking units 70*a* to 70*c* (HP1 to HP3) (first process portion) and the auxiliary pre-baking unit 70*s* (HPS) (second process portion) are changed to the process condition for substrates G of the lot to be processed after the next. In that state, the thermal processes can be successively performed for a plurality of substrates G. Thus, substrates G of a plurality of lots can be successively processed in different process conditions. Consequently, when only one auxiliary pre-baking unit 70*s* (HPS) (second process portion) is added, thermal processes can be successively performed for substrates G of a plurality of lots in different process conditions.

Since a low temperature heat flow and a high temperature heat flow take place downward and upward, respectively, according to the forgoing embodiment, substrates are successively loaded to pre-baking units in the order from a lower unit to an upper unit. Thus, substrates can be successively processed without loss of thermal energy.

Since the present invention is structured as described above, the following excellent effects can be obtained.

Process conditions of the first process portion and at least one unit as the second process portion are changed to a process condition for workpieces of a lot to be processed next. Processes can be successively performed for a plurality of workpieces. Thus, the apparatus can be kept in a small size. In addition, processes can be successively performed for a plurality of workpieces in different process conditions. Moreover, with only at least one unit as the second process portion added, a plurality of workpieces can be successively processed in different process conditions.

The first process portion is composed of a plurality of process units. Process conditions of the process units are changed to a process condition for workpieces to be processed next. Workpieces to be processed next are successively loaded to the process units whose process conditions have been changed. In the process units, the processes are performed for the workpieces. Thus, a plurality of workpieces can be processed simultaneously. Thus, in addition to the effect 1), the process efficiency can be further improved.

Since the first process portion and the second process portion are thermal process portions that perform thermal processes at respectively predetermined temperature conditions, thermal processes can be successively performed for a plurality of workpieces in different thermal process conditions.

The disclosure of Japanese Patent Application No. 2002-134882 filed May 10, 2002 including specification, drawings and claims are herein incorporated by reference in its entirety.

Although only some exemplary embodiments of this invention have been described in details as above, those skilled in the art should readily appreciate that many modifications are possible in the exemplary embodiments without materially departing from the novel teachings and advantages of this invention. Accordingly, all such modifications are intended to be included within the scope of this invention.

What is claimed is:

1. A processing method, comprising the steps of:

(a) setting a first process portion for processing a plurality of workpieces for a first process condition;

(b) after the step (a), causing the first process portion to process a first workpiece of the plurality of workpieces in the first process condition;

(c) setting a second process portion for processing the plurality of workpieces for a second process condition;

(d) after the step (c), causing the second process portion to process a second workpiece of the plurality of workpieces in the second process condition;

(e) after the step (b) and during the step (d), changing and setting the first process portion for the second process condition; and (f) after the step (e), causing the first process portion to process a third workpiece of the plurality of workpieces in the second process condition.

2. The processing method as set forth in claim 1, wherein the step (c) is performed during the step (b).

3. The processing method as set forth in claim 1, wherein the step (b) has the step of:

(g) causing the first process portion to process the first workpiece as a workpiece contained in a first lot, wherein the step (d) has the step of: (h1) causing the second process portion to process the second workpiece as a workpieces contained in a second lot to be processed after the first lot, and wherein the step (f) has the step of: (h2) causing the first process portion to process the third workpiece as a workpieces contained in the second lot to be processed after the first lot.

4. The processing method as set forth in claim 3, wherein the first process portion has a first process unit and a second process unit for processing the plurality of workpieces and the there are a plurality of third workpieces, wherein the step (e) has the steps of:

(i) changing and setting the first process unit for the second process condition; and (j) after the step (i), changing and setting the second process unit for the second process condition, and wherein the step (f) has the steps of:

(k) after the step (i), causing the first process unit to process one of the plurality of third workpieces; and (l) after the step (j), causing the second process unit to process another workpiece of the plurality of third workpiece.

5. The processing method as set forth in claim 1, further comprising the steps of:

before the step (a), storing a time necessary after the step (c) until the start of the step (d); and performing the step (c) corresponding to the stored time, so as to cause the step (d) to start before performing the step (e) at latest.

6. The processing method as set forth in claim 1, wherein the step (a) is performed by setting the first process portion for a first temperature condition as the first process condition, wherein the step (b) is performed by causing the first process portion to process the workpiece in the first temperature condition, wherein the step (c) is performed by setting the second process portion for a second temperature condition as the second process condition, wherein the step (d) is performed by causing the second process portion to perform a thermal process for the workpiece in the second temperature condition;

wherein the step (e) is performed by setting the first process portion for the second temperature condition as the second process condition, and wherein the step (f) is performed by causing the first process portion to perform a thermal process for the workpiece in the second temperature condition.

7. A processing method for successively processing a plurality of workpieces in different process conditions, the processing method comprising the steps of:

providing a first process portion to be set for a process condition for a workpiece to be processed first;

providing a second process portion to be set for a process condition for a workpiece to be processed next, the second process portion being composed of at least one unit;

allowing the first process portion and the second process portion to be changed to their process conditions;

while the workpiece to be processed first is being transferred to the first process portion and the workpiece is being processed therein, setting the second process portion for the process condition for the workpiece to be processed next and placing the second process portion in a ready state for processing the workpiece;

after the first process portion has processed the workpiece, transferring the workpiece to be processed next to the second process portion and causing the second process portion to process the workpiece;

while the second process portion is processing the workpiece, changing the first process portion to the same process condition as that of the second process portion, transferring the workpiece to be processed next to the first process portion whose process condition has been changed, and causing the first process portion to process the workpiece;

after the second process portion has processed the workpiece, changing the second process portion to a process condition for a workpiece to be processed after the next and placing the second process portion in a ready state for processing the workpiece; and changing the first process portion and the second process condition to the process condition for the workpiece to be processed next and causing the first process portion and the second process portion to successively process the plurality of workpieces.

8. The processing method as set forth in claim 7, further comprising the steps of:

providing the first process portion composed of a plurality of process units;

successively changing the process units to the process condition for the workpiece to be processed next;

transferring the workpiece to be processed next to the process units whose process conditions have been changed; and causing the process units to process the workpiece.

9. The processing method as set forth in claim 7, wherein the first process portion and the second process portion are thermal process portions for performing thermal processes for workpieces in respectively predetermined temperature conditions.

10. A processing apparatus, comprising:

a first process portion for processing a plurality of workpieces in at least a first process condition and a second process condition that is different from the first process condition;

a second process portion for processing the workpieces in at least the second process condition; and controlling means for changing the first process portion to the second process condition and causing the first process portion to process a third workpiece of the workpieces in the second process condition, after the first process portion has processed a first workpiece of the workpieces in the first process condition while the second process portion is processing a second workpiece of the workpieces.

11. The processing apparatus as set forth in claim 10, wherein the first workpiece is contained in a first lot and the second and third workpieces are contained in a second lot to be processed after the first lot.

12. The processing apparatus as set forth in claim 11, wherein the first process portion has a first thermal process unit for performing a thermal process for the workpieces in the first process condition and the second process condition as a first temperature condition and a second temperature condition, respectively, and wherein the second process portion has a second thermal process unit for performing a thermal process for the workpieces in the second process condition as the second temperature condition.

13. The processing apparatus as set forth in claim 12, wherein the first thermal process unit and the second thermal process unit are vertically disposed, wherein the processing apparatus further comprises:

a transferring mechanism for transferring the workpieces at least between the first thermal process unit and the second thermal process unit, and wherein the controlling means has:

means for sending a command for causing the workpieces to be successively transferred to the first and second thermal process units in the order from a lower unit to an upper unit.

14. A processing apparatus for successively processing a plurality of workpieces in different process conditions, the processing apparatus comprising:

a loading and unloading portion for loading and unloading the workpieces;

a process portion having a first process portion and a second process portion that can be set for different process conditions for the workpieces, the second process portion being composed of at least one unit;

transferring means for transferring and transferring the workpieces between the loading and unloading portion and the process portion; and controlling means for setting the second process portion for a process condition for a workpiece to be processed next while the first process portion is processing a workpiece to be processed first, sending a command to the transferring means so as to transfer the workpiece that has been processed in the second process portion, and changing the first process portion to the process condition for the workpiece to be processed next.

15. The processing apparatus as set forth in claim 14, wherein the first process portion has a plurality of process units, and wherein the controlling means is configured to control the process units so that the process units can be successively changed and set for process conditions.

16. The processing apparatus as set forth in claim 14, wherein the first process portion and the second process portion are thermal process units for performing thermal processes for the workpieces in respectively predetermined temperature conditions.

17. The processing apparatus as set forth in claim 16, wherein each of the first and second process portions has:

a holding table for holding a workpiece;

heating means for heating the holding table;

cooling means for cooling the holding table;

temperature detecting means for detecting the temperature of the holding table; and controlling means for controlling the heating means or the cooling means corresponding to a detection signal that is output from the temperature detecting means or a pre-set workpiece process start signal or a pre-set workpiece process end signal.

* * * * *